United States Patent [19]

Viro et al.

[11] 4,252,894

[45] Feb. 24, 1981

[54] HYDROPHILIC COLOR COUPLER COMPOSITION CONTAINING DIEPOXIDE

[75] Inventors: Felix Viro, Apalachin, N.Y.; Salvatore Emmi, Portland, Oreg.

[73] Assignee: GAF Corporation, New York, N.Y.

[21] Appl. No.: 624,923

[22] Filed: Oct. 22, 1975

Related U.S. Application Data

[63] Continuation-in-part of Ser. No. 518,798, Oct. 29, 1974, Pat. No. 3,989,529.

[51] Int. Cl.[3] ..... G03C 1/10; G03C 1/40; G03C 1/38

[52] U.S. Cl. ..... 430/545; 430/546; 430/637

[58] Field of Search ..... 96/100, 97, 114.5; 252/351; 106/135, 137

[56] References Cited

U.S. PATENT DOCUMENTS

| | | | |
|---|---|---|---|
| 2,322,027 | 6/1943 | Jelley et al. | 96/97 |
| 3,287,134 | 11/1966 | Kainrath et al. | 96/100 |
| 3,316,094 | 4/1967 | Ben-Ezra | 96/100 |
| 3,409,435 | 11/1968 | Seidel et al. | 96/100 |
| 3,725,080 | 4/1973 | Mackey | 96/114.5 |
| 3,960,569 | 6/1976 | Ono | 96/55 |

*Primary Examiner*—Richard L. Schilling
*Attorney, Agent, or Firm*—W. C. Kehm; E. G. Comrie

[57] ABSTRACT

Hydrophilic coupler-oil solutions are stabilized by the addition of an epoxide compound. These coupler compounds are dissolved, with the aid of epoxide compounds, in high boiling esters and dispersed in aqueous gel solutions to form dispersions of improved stability.

2 Claims, No Drawings

HYDROPHILIC COLOR COUPLER COMPOSITION CONTAINING DIEPOXIDE

The present application is a Continuation-in-part of our copending application Ser. No. 518,798 filed Oct. 29, 1974, now U.S. Pat. No. 3,989,529.

This invention relates to the preparation of improved hydrophilic coupler-oil solutions for use in preparation of color coupler-oil dispersions. More particularly, it relates to stabilized hydrophilic color coupler-oil solutions employed in the preparation of color coupler-oil dispersions in aqueous gelatin.

Water soluble couplers are normally dissolved as alkali metal salts in aqueous solution which solutions are added to the gelatin silver halide emulsion prior to coating the emulsion onto a support. Many of the couplers used in the preparation of commercial color photographic products exhibit poor stability in aqueous solution. Depending upon the individual coupler used, crystalization often occurs within a one-half hour to 24 hour period. Furthermore, as the concentration of coupler in solution increases, the stability of the resulting aqueous solution decreases. Serious problems are encountered in connection with the manufacture of modern color products in which the concentration of coupler in the solution to be added to the gelatin-silver halide emulsion is 10% or higher. These color products are characterized by having thinner coatings and gelatin silver halide emulsions with higher concentrations of silver. Such coating formulations tolerate less water which, in turn, requires more concentrated coupler solutions. It is therefore desirable, in the coating of gelatin silver halide emulsions to develop stable concentrated hydrophilic coupler dispersions.

Gelatin silver halide emulsions are known to interact with hydrophilic couplers resulting in an increase in viscosity. Extensive studies have been done on this phenomenon; Mazzucato et al, *The Journal of Photographic Science,* Vol. 16, page 63, (1968) and Evva et al, *Kolloid-Zeitschrift* 149, 10 (1956). Various methods are known which reduce this viscosity increase, such as alteration of pH, or addition of certain organic solvents. Seidel et al, U.S. Pat. No. 3,409,435, teaches the use of poly-1,3-propylene glycol ethers as viscosity reducing agents. Additives of this nature are generally satisfactory in reducing the rate of viscosity increase, but, in most cases, their use creates other problems, such as, instability or difficulty in coating.

It is an object of this invention to provide a stable hydrophilic color coupler-oil solution. It is a further object of the present invention to provide a method of incorporating hydrophilic color couplers into a dispersed oil phase. It is another object of this invention to develop such a hydrophilic coupler-oil solution which would also have the effect of preventing or minimizing the viscosity increase which occurs upon contacting aqueous color coupler solutions with gelatin solutions.

Other objects and advantages will be apparent from the following disclosure.

This invention provides new hydrophilic coupler solutions containing diepoxides or ethylene glycol diglycidyl ether. These solutions themselves exhibit unexpectedly improved stability. Furthermore, when hydrophilic couplers are dissolved in high boiling esters such as tricresyl phosphate and dibutylphthalate by means of epoxides and are dispersed in gelatin solutions, viscosity increase is substantially avoided. This is particularly unexpected since epoxides are well known to the art as hardeners for gelatin but do not so function in the present invention though present in relatively large amounts.

The color couplers which are contemplated for use in connection with the present invention include the hydrophilic couplers generally used in connection with color systems. Such couplers can be generally described as phenol and naphthol type cyan couplers ballasted to an equivalent of an aliphatic chain of at least ten carbon atoms and having at least one sulfo or carboxy group to render them alkali soluble; 1-phenyl pyrazolone type magenta couplers ballasted to an equivalent of an aliphatic chain of at least ten carbon atoms and having at least one sulfo or carboxy group to render them alkali soluble; benzoyl acetanilide type yellow couplers ballasted to an equivalent of an aliphatic chain of at least ten carbon atoms and having at least one sulfo or carboxy group to render them alkali soluble; and pivalyl acetanilide type yellow couplers ballasted to an equivalent of an aliphatic chain of at least ten carbon atoms and having at least one sulfo or carboxy group to render them alkali soluble. Examples of such couplers include:

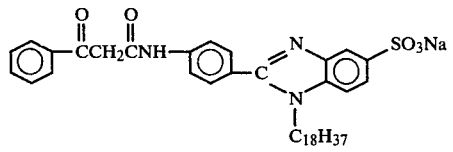

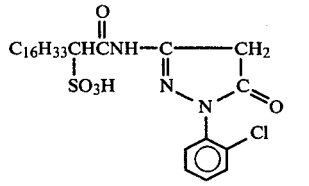

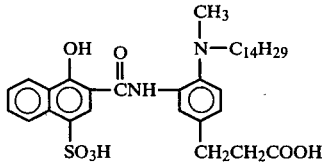

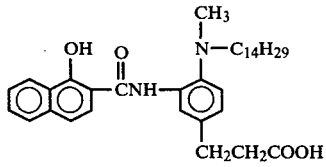

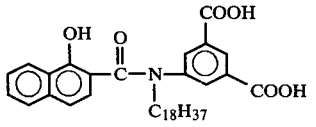

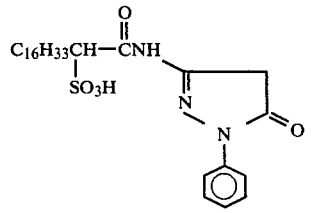

-continued

"G"

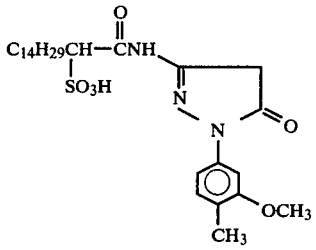

"H"

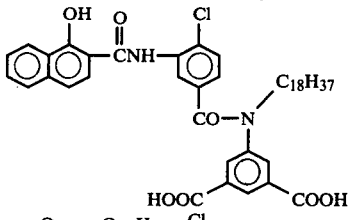

"I"

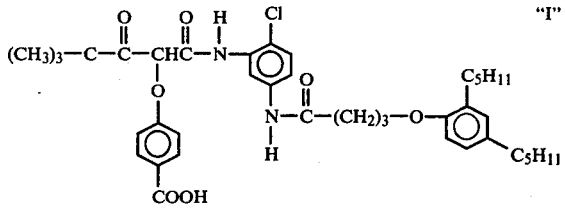

"J"

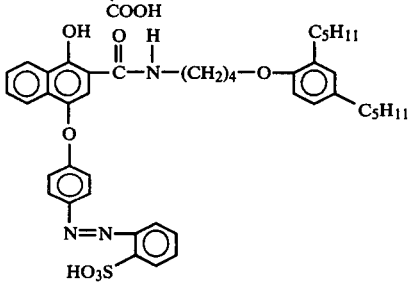

The concentration of these couplers in solution may be generally between about 1% and 20% but preferably between about 5% and 10%.

The additives which are used in solution with the color couplers, in accordance with this invention, include diepoxides and ethlene glycol diglycidyl ethers. "Diepoxides" is intended to mean low molecular weight resinous polymeric products, the molecular weight being between about 170 and 400. Especially useful is the condensation product of glycerin and epichlorohydrin. Other suitable diepoxides useable in the present invention include:

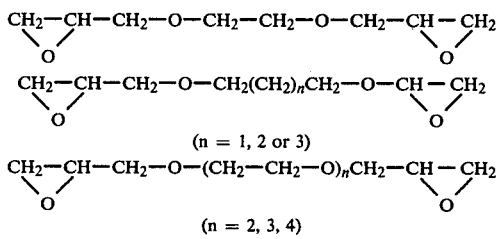

The amount of epoxides used will depend largely upon the particular hydrophilic color coupler employed. Generally, the epoxide will be used in amounts of between about 1% and 20%, preferably 2% and 10% based on the weight of the coupler.

The actual concentration depends on the specific molecular weight relationship of color former to epoxide and the inherent solubility characteristics of the color former. The choice of an appropriate epoxide concentration is within the skills of persons knowledgeable in the art.

The hydrophilic color couplers are incorporated into an oily ester by means of the epoxide solubilizers and uniformly dispersed as discrete droplets throughout the aqueous gelatin solution in conventional manner. It has been determined that dispersions of the high boiling oily esters which contain the dissolved hydrophilic color coupler are considerably aided by incorporating 0.2 to 5% by weight and preferably 0.5 to 2% by weight of an anionic surfactant such as sodium alkyl naphthalene sulfonate into the aqueous gelatin solution prior to introducing said oily esters. The resulting oil phase droplets are generally uniformly distributed, stable and may comprise up to 40% by weight of the dispersion. The dispersion thus prepared may in turn be added to silver halide emulsion with proper dispersing means to obtain a final coating composition.

This invention will be better understood by reference to the following examples which are included here for purposes of illustration and comparison and are not to be construed as limitations. Unless otherwise stated, all percentages and parts are by weight.

EXAMPLE I

A 10% solution of coupler "A" is made by dissolving 10 grams of coupler "A" in 80 cc of water and 10 cc of methanol. The pH of this solution was 8.1. 43 ml. of the solution and 60 ml. of additional dilution water were added to 100 grams of medium speed silver bromoiodide emulsion, containing 5 mol % iodide, 5% silver and 7% gelatin. Within 15 minutes, the resulting solution become too viscous for coating.

This example demonstrates the difficulty encountered when incorporating a hydrophilic coupler into an aqueous silver halide emulsion by simply dissolving it in water and methanol.

EXAMPLE II

A 5 g sample of coupler "A" was dissolved in 95 ml of water. The aqueous solution of coupler was added with mixing to 100 g of the silver halide described in Example I and coated to a silver weight of 1.2 g/m$^2$. After exposure and processing the dye to silver ratio (dye peak density/silver density at 900 m$\mu$) was determined to be 5:1. It is to be noted that if the coating is not done within about 60 minutes of mixing coupler with silver halide emulsion the composition becomes too viscous for coating.

EXAMPLE III

A 4 gram sample of Coupler "A" was dissolved in 60 ml of dibutylphthalate and 3 ml of methanol. A clear solution was obtained upon heating but, upon cooling to room temperature, the coupler precipitated out. This example demonstrates that without use of an epoxide a stable solution of hydrophilic coupler in oil is not obtained even with a large ratio of oil to coupler.

Examples IV–IX of the present invention follow.

EXAMPLE IV

A 4 g sample of coupler "A" was dissolved in a solution of 3.0 ml of Dibutylphthalate, 3.0 ml of Eponite 100 and 3 ml of methanol. The resulting solution was clear after heating. When cooled and stored at room temperature, the solution remained clear. This example demonstrates that stability of hydrophilic color coupler in oil is obtained with the aid of an epoxide.

EXAMPLE V

A 5 g sample of coupler "A" is dissolved in a solution of 4 ml of dibutylphthalate, 4 ml of Eponite 100, a low molecular weight condensation product of glycerine and epichlorohydrin, and 3 ml of methanol. A clear solution results, which is then dispersed in an aqueous solution of 1 g gelatin in 45 ml of water and 3 ml of Alkanol B, a 10% aqueous solution of sodium alkyl naphthalene sulfonate. The dispersion is added with mixing to 100 g of silver bromoiodide emulsion containing 5 mole % iodide, 5% silver and 7% gelatin and coated to a silver weight of 1.2 g/m$^2$. Exposed and processed strips were used to determine the dye to silver ratio (dye peak density/silver density at 900 m$\mu$) which was 5:1, the same as in Example II.

EXAMPLE VI

A dispersion of coupler "A" was made by dissolving 50 g of the coupler in 10 ml of Eponite 100, 60 ml of dibutylphthalate, 30 ml of methanol and 3 ml of 30% aqueous ammonium hydroxide. The solution was heated in a steam bath. This oil solution was dispersed in 350 ml of gelatin solution (5 g gelatin) and 40 ml of a 10% aqueous solution of Alkanol B.

EXAMPLE VII

A dispersion of coupler "B" was made by following the procedure described in Example VI, except 5.5 ml of 30% aqueous ammonium hydroxide was added to aid solubility.

EXAMPLE VIII

A dispersion of coupler "C" was made by following the procedure described in Example VI, except 3.0 ml of 30% aqueous ammonium hydroxide was added to aid solubility.

The conventional method of incorporating hydrophilic color couplers is demonstrated in Example X.

EXAMPLE IX

A coating containing three sensitized emulsion layers was prepared using the dispersions made in Examples VI, VII and VIII.

On a clear, subbed film base was coated a solution combining 100 g of silver bromoiodide emulsion as set forth in Example I, sensitized to red light, 50 g of the coupler "C" dispersion made in Example VIII and coating aids and stabilizers known in the art. This red light sensitive cyan coupler containing layer was coated to a silver weight of 1.1 g/m$^2$.

On the red sensitive layer was coated a 1.0$\mu$ thick gelatin separation layer.

The green sensitive emulsion layer was coated to silver weight of 0.9 g/m$^2$, containing 50 g of the coupler "B" dispersion from Example VII per 100 g of green light sensitized silver bromoiodide emulsion. The green light sensitive layer coated over the gelatin separation layer was then overcoated with a Carey-Lee yellow filter colloidal silver layer having a blue density of 1.1.

The yellow filter layer was overcoated with the blue sensitive emulsion, containing 50 g of coupler "A" dispersion from Example VI per 100 g of silver halide emulsion, to a silver weight of 1.2 g/m$^2$.

The coated material was exposed and processed reversibly to give good color reproduction and low apparent graininess.

EXAMPLE X

A three emulsion layer coating was prepared as in Example IX, except that the same amount of couplers "A", "B" and "C" were added as 5% aqueous solutions. Each emulsion layer was coated to the same silver and color coupler content. The coating was exposed and processed. Some color contamination was observed which was verified under microscope inspection showing dye from coupler "C" in the separation layer and the dye from coupler "B" in the yellow filter and the bottom of the yellow layer.

It has been shown in the preceding examples that hydrophilic color coupler can be dissolved in a high boiling photographically inert vehicle which, in turn can be dispersed as discrete droplets in aqueous silver halide gelatin emulsions. These emulsions, when coated, retain the color couplers in the discontinuous phase of the emulsion preventing the couplers from migrating or diffusing from the layer selected. They act in this respect as true lipophilic color couplers. Unexpectedly, however, though dissolved in the oil phase of the dispersion, they retain their high coupling efficiency.

There are indications that under alkaline development conditions a portion of the color coupler is released from the oily phase of the dispersion to the aqueous continuous phase but their diffusion (migration) is quite limited. The result of this is improved graininess due to reduced contrast between the dye density of oil droplets and dye density of the aqueous gel phase.

This invention has been disclosed with respect to certain preferred embodiments. It will be understood that modifications therein will be obvious to persons skilled in the art and are included in the spirit and purview of this application and the scope of the appended claims.

What is claimed is:

1. A method for preparing a dispersion of stabilized hydrophilic color coupler in a gelatin silver halide emulsion which comprises dissolving said hydrophilic color coupler in a high boiling, photographically inert ester and a diepoxide, dispersing the coupler-ester solution in an aqueous gel solution containing a suitable anionic surfactant to form a first dispersion and adding this dispersion to an aqueous gelatin silver halide gel emulsion.

2. A method as set forth in claim 1 wherein the anionic surfactant is sodium alkyl napthalene sulfonate.

* * * * *

Disclaimer 4,252,894.—*Felix Viro,* Apalachin, N.Y.; and *Salvatore Emmi,* Portland, Oreg. HYDROPHILIC COLOR COUPLER COMPOSITION CONTAINING DIEPOXIDE. Patent dated Feb. 24, 1981. Disclaimer filed Sept. 30, 1982, by the assignee, *Eastman Kodak Co.*

Hereby enters this disclaimer to all claims of said patent.

[*Official Gazette February 8, 1983.*]